United States Patent [19]

James

[11] 4,071,419

[45] * Jan. 31, 1978

[54] ELECTRODEPOSITION OF ZINC AND ADDITIVE THEREFORE

[75] Inventor: Barrie Sydney James, Kingswinford, England

[73] Assignee: W. Canning & Company, Ltd., Birmingham, England

[ * ] Notice: The portion of the term of this patent subsequent to Jan. 31, 1995, has been disclaimed.

[21] Appl. No.: 675,500

[22] Filed: Apr. 9, 1976

[30] Foreign Application Priority Data

Apr. 15, 1975 United Kingdom ..... 15482/75

[51] Int. Cl.[2] ..... C25D 3/22

[52] U.S. Cl. ..... 204/55 R; 204/DIG. 2

[58] Field of Search ..... 204/55 R, 55 Y, 43 Z, 204/44, 114, DIG. 2

[56] References Cited

U.S. PATENT DOCUMENTS

| | | | |
|---|---|---|---|
| 1,564,414 | 12/1925 | Hoff | 204/50 Y |
| 3,886,054 | 5/1975 | Duchene et al. | 204/55 R |

*Primary Examiner*—G. L. Kaplan

*Attorney, Agent, or Firm*—Marn & Jangarathis

[57] ABSTRACT

Bright zinc plate is obtained from alkaline, cyanide-free zinc plating baths containing at least one linear polyamine obtained by condensing an aliphatic diamine with an aliphatic dihalide. Especially good results are obtained if the bath also contains at least one substituted pyridine compound in the form of a free base or as a quaternised derivative. A brightener composition containing both the linear polyamine and the pyridine compound can be added to alkaline, cyanide-free zinc plating baths.

24 Claims, No Drawings

ELECTRODEPOSITION OF ZINC AND ADDITIVE THEREFORE

This invention relates to the electrodeposition of zinc from an alkaline bath and more particularly to the addition of specific combinations of compounds, which are prepared as described below, to such baths to produce bright deposits.

At present the major proportion of commercially fabricated components are coated with zinc electrodeposits plated from alkaline solutions containing a soluble zinc salt, hydroxide ion and quantities of cyanide. The use of such cyanide-containing baths poses considerable problems in operation from the very poisonous nature of cyanide and also from the disposal of wastes, like spent solutions and other discharged effluent from running-water rinsing tanks. Since the limits on the quantities of cyanide that may be discharged are being reduced, effluent treatment is becoming increasingly more difficult and consequently more expensive. As the maximum tolerances imposed by various Government Authorities become lower, their achievement necessitates the installation of expensive effluent treatment plants and closer control of all cyanide-containing materials, including spent or waste solutions.

It is with these problems in mind that more attention is being given to non-cyanide plating processes. These may be divided into three main classes - acid, neutral and alkaline. All three have their individual characteristics, although the neutral process, which works in the pH range 6–8, is really only an extension of the acid zinc plating process based on solutions which operate in the pH range of 3–6. The neutral and acid processes are frequently based on $NH_4Cl$ or $NH_4SO_4$, with the ammoniumion playing the same complexant role as cyanide does in the normal commercial cyanide plating processes.

Alkaline non-cyanide baths operate in the pH range 8–14, usually between pH 10–12, and are based on a solution of sodium zincate with excess hydroxide ions. This type of bath without any addition agent yields a dull, spongey electrodeposit of poor appearance. There thus exists a need for addition agents to prevent electrodeposits of this type and to give instand a bright and uniform mirror-like electrodeposit of pleasing appearance.

A problem often associated with the conventional cyanide-free alkaline zinc solutions now commercially available is that they do, in fact, require addition of small amounts of cyanide ions in order to produce a deposit of acceptable brightness. Alternatively, a conventional type of complexing agent, such as sodium gluconate, is added which usually creates more effluent problems than it solves. Conventional complexing agents pose the problem that they render it difficult to remove zinc from the effluent water and should this effluent be mixed with that from other processes, such as those from nickel or copper plating, then these metals too are very strongly complexed and difficult to remove from solution by the conventional purification techniques. This means even more expensive effluent purification techniques are necessary.

The present invention provides the use of a polyamine addition agent in cyanide-free alkaline zinc plating solutions to aid the production of bright uniform zinc electrodepositions. The invention also provides a combination of a polyamine addition agent and a pyridine compound having a synergistic effect.

According to the present invention there is provided an alkaline, cyanide-free zinc plating bath containing zinc ions and hydroxyl ions and at least one linear polyamine obtained by condensing a diamine of the formula:

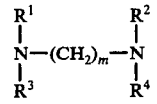

(I)

where $R^1$, $R^2$, $R^3$ and $R^4$, which may be the same of different, each represent a hydrogen atom or an alkyl group with 1 to 4 carbon atoms, and where $m$ is an integer from 1 to 5, with an alkyl dihalide of the formula:

$$X-(CH_2)_n-Y-(CH_2)_p-X \qquad \text{(II)}$$

where X represents a halogen atom; Y represents an oxygen atom, an ethylnylene group (—C≡C—), an ethenylene group (—HC=CH—), or a group

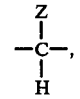

where Z represents a hydrogen atom, an alkyl group with 1-4 carbon atoms or a hydroxy group, and $n$ and $p$, which may be the same or different, are zero or an integer from 1 to 5; provided that when Z represents a hydroxy group and $n$ and $p$ are both 1, $R^1$ and $R^2$ in formula (I) both represent hydrogen atoms.

According to the invention there is also provided a combination of one or more polyamines as defined above together with one or more pyridine compounds substituted (preferably in the 3- position) with a cyano, carboxy (free or as a salt), esterified carboxy, carbamoyl or substituted carbamoyl group. The substituted carbamoyl group is preferably an alkyl-substituted carbamoyl group.

The pyridine compounds may be in the form of free bases or quaternised with a conventional quaternising agent.

The pyridine compound is advantageously of the general formula:

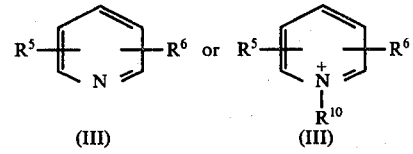

(III) (III)

where $R^5$ represents a hydrogen atom or an alkyl group with 1 to 5 carbon atoms; and $R^6$ represents a cyano group, a group $-COOR^7$ where $R^7$ represents a hydrogen atom, an alkali metal cation or an alkyl group with 1 to 5 carbon atoms; or a group $-CONR^8R^9$ where $R^8$ and $R^9$ which may be the same or different each represents a hydrogen atom or an alkyl group with to 1 to 5 carbon atoms; and $R^{10}$ represents an aralkyl, alkyl, alkenyl, esterified carboxyalkyl or hydroxyalkyl group. $R^6$ is preferably in the 3- position.

The quaternising agent is preferably an aralkyl halide such as benzyl chloride or a halo-ester such as ethyl chloroacetate.

Table I illustrates examples of the substituted pyridine compounds and Table III some of the quaternising agents. These Tables are not intended to be exclusive and only illustrate the types of organic chemicals which may be used in this invention.

TABLE I

| Substituted Pyridines of Formula II |
|---|
| Nicotinic acid |
| Nicotinamide |
| N,N-Diethyl-nicotinamide |
| 3- Cyanopyridine |
| 4- Cyanopyridine |
| Methyl nicotinate |
| Ethyl nicotinate |
| Isonicotinic acid |
| 2- Picolinic acid |
| Butyl nicotinate |

TABLE II

| Quaternizing Agents | Quaternising Group Provided |
|---|---|
| Benzyl chloride | Benzyl |
| Ethyl Chloroacetate | Ethoxycarbonylmethyl |
| 1- Bromopropane | Propyl |
| 3- Bromopropene (allyl bromide) | Allyl |
| Ethyl chloride | Ethyl |
| Ethylene oxide | 2- Hydroxyethyl |
| 3- Ethyl-bromo-propionate | 2- Ethoxycarbonylethyl |
| 2- Chloro-ethanol | 2- Hydroxyethyl |
| Propylene oxide | 2- Hydroxypropyl |

Some of these compounds and their preparation are described in British Patent Specification No. 1,170,058 (E. I. Du Pont de Nemours & Co.) and 1,047,132 (The Udylite Corporation). These patents are concerned with the application of compounds in cyanide plating baths. In non-cyanide baths quaternised pyridine compounds by themselves have very little effect compared with the spectacular changes wrought by them in conventional cyanide baths. Even their combination with colloids found to be beneficial in cyanide baths does little in non-cyanide baths and only results in a dull spongey electrodeposit little better than that obtained from the inorganic solution without any organic addition agents being present.

The quaternised pyridinium compounds are again only effective in combination with the polyamines already mentioned, when brilliant uniform deposits may be achieved by using both the addition agents in the correct combination.

The linear polyamines of this invention may be prepared by refluxing a diamine, examples of which are illustrated in Table III, with a dihalide, examples of which are illustrated in Table IV, in a suitable solvent. As solvent water is preferred, but also alcohols, ethers, aromatic hydrocarbons such as benzene, or similar organic solvents may be used. The amount of both reactants may be varied to yield compounds of varied molecular weight. Where the diamine of general formula (I) has more than one of $R^1 - R^4$ representing other than hydrogen at each end of the molecule, the polyamine product will, of course, comprise a poly-quaternary system, otherwise a polyamine free of quaternary groups is obtained.

All aspects of the invention apply both to zinc electroplating performed by suspending articles on conducting jigs hung in the solution and also to zinc plating carried out in so-called barrels. Barrel plating, a term well known in the trade, implies a bulk of articles being electroplated either in a hollow plastics or rubber vessel with perforated walls immersed and rotating in the solution or in a hollow plastics or rubber vessel with solid walls revolving at some angle above the horizontal, in both cases electrical contact being made to the bulk of articles by metal conductors inserted through the walls.

TABLE III

| Generic Formulae | Examples |
|---|---|
| $H_2N(CH_2)_nNH_2$ | 1,2-diaminoethane |
| | 1,3-diaminopropane |
| | 1,4-diaminobutane |
| $R_1HN(CH_2)_nNH_2$ | 3-methylaminopropylamine |
| | 3-cyclohexylaminopropylamine |
| $R_1HN(CH_2)_nNHR_2$ | N,N'-diethyl-ethylenediamine |
| | N,N'-dimethyl-ethylenediamine |
| $R_1R_3N(CH_2)_nNH_2$ | 3-dimethylamino-propylamine |
| | 3-diethylamino-propylamine |
| | 4-diethylamino-butylamine |
| | 2-dimethylamino-ethylamine |
| | 2-diethylamino-ethylamine |
| $R_1R_3N(CH_2)_nNHR_2$ | N,N,N'-trimethyl-ethylene diamine |
| | N,N,N'-triethyl-ethylene diamine |
| $R_1R_3N(CH_2)_nNR_2R_4$ | N,N,N',N'-tetramethyl-1,2-diamino-ethane |

TABLE IV

| |
|---|
| 1,2-dibromoethane |
| 1,2-dibromoethylene |
| 1,3-dibromobutane |
| 1,4-dibromobutane |
| 1,4-dibromobutan-2-ol |
| 1,6-dibromohexane |
| 1,2-dibromopropane |
| 1,3-dibromopropane |
| 1,3-dibromopropan-2-ol |
| 1,4-dibromobut-2-yne |
| 1,2-dichlorobutane |
| 1,3-dichlorobutane |
| 1,4-dichlorobutane |
| 1,3-dichloro-2-butene |
| 1,4-dichloro-2-butyne |
| 1,2-dichloroethane |
| 1,2-dichloroethylene |
| 1,6-dichlorohexane |
| 1,2-dichloropropane |
| 1,3-dichloropropane |
| 1,3-dichloropropan-2-ol |
| Di-(2-chloroethyl)ether |
| 1,2-diiodoethane |
| 1,3-diiodopropane |
| 1,4-diiodobutane |

The production of different molecular weights of polyamine may be illustrated by considering the following simplification. If two moles of a diamine ($CH_3NHCH_2CH_2CH_2NH\ CH_3$) are reacted with one mole of a simple dialkyl halide e.g. dibromo-propane, the product expected contains two molecules of the amine joined with a propane bridge. If, however, only one mole of each is taken, a higher molecular weight would be expected, the chain length depending on the reaction time and conditions. Thus the nearer the ratio of reactants approaches 1:1 the more higher molecular weight components will be present in the reaction mixture. Conveniently, the ratio of diamine to dihalide used may vary from 2:1 to 1:2.

On fact that must be borne in mind when making these polymers is that the reactants may cyclise instead of producing linear products, particularly if the diamine is symmetrical and short, e.g. ethylene diamine and the dihalide is relatively long, e.g. di-(2-chloroethyl) ether.

This problem may be limited by making a suitable choice of reactants and reaction conditions so that the percentage of cyclised material is reduced or even eliminated.

In the reaction of a primary or secondary amine with an organic halide the yield may be improved by using a non-reactive base such as sodium hydroxide or sodium carbonate to remove the hydrogen halide produced and so induce the reaction to proceed to completion.

The proportion of polyamine used in the plating bath is desirably in the range 0.01 to 100 g/liter, advantageously 0.1 to 10 g/liter. The corresponding porportion of the pyridine compound when used in combination is desirably 0.01 to 50, advantageously 0.1 to 5 g/liter.

The polyamine compounds and pyridine compounds described above can be mixed together to produce a liquid additive composition containing the compounds in the correct proportion to prepare and maintain a zinc plating bath according to the invention. A ready means is thus provided for the addition of the individual chemicals in the correct ratio not only as an initial addition but as mixtures of different proportions to replace these compounds as they are lost by chemical or electro chemical consumption or by physical losses resulting from "drag-out" of plating solution.

These mixtures can, in general, contain in aqueous solution, 20–600 g/liter of the linear polyamine and 10–200 g/liter of the pyridine compound for example a liquid composition for addition to a zinc plating bath already containing the required inorganic compounds, in order to prepare a bath according to this invention, may contain 150–250 g/liter of linear polyamine and 50–150 g/liter of quaternised pyridine compound while a liquid composition for maintaining a bath, may contain 110–170 g/liter of the linear polyamine and 25–75 g/liter of quaternised pyridine compound.

The following Examples illustrate the production of compounds useful in the process of this invention and their use.

EXAMPLE I 49.8 ml (0 2 mole) 3-dimethylaminopropylamine were dissolved in 100 ml of water and then 17.2 ml (0 1 mole) 1,3-dibromopropane were added slowly with stirring. The mixture was refluxed for 3 hours and then diluted to make a 20% solution which was then tested by adding it to an alkaline non-cyanide zinc solution which is plated in a Hull cell as described later.

EXAMPLE 2

11.6 g (0.1 mole) N,N,N',N'-tetramethyl-1,2-diaminoethane and 18.8 g (0.1 mole) 1,2-dibromoethane were dissolved in 100 ml of Industrial Methylated Spirits and placed in a 250 ml round bottomed flask fitted with a reflux condenser. The mixture was refluxed for five hours then diluted with water as in Example 1 to 20% strength ready for testing.

EXAMPLE 3

11.6 g (0 1 mole) of N,N-dimethyl-N'-ethylethylenediamine and 10.0 ml (20.2 g = 0 1 mole) of 1,3-dibromopropane were dissolved in 50 ml of ethyl cellosolve in a 150 ml round bottomed flask with a reflux condenser. After the initial reaction had ceased the mixture was refluxed for one hour then diluted as in Example 1 to 10% strength ready for testing.

EXAMPLE 4

20.4 g (0.2 mole) N,N,N'-trimethyl-ethylenediamine was dissolved in 100 ml of water in a 250 ml round bottomed flask fitted with stirrer and condenser. 23.9 g (0 16 mole) of 2,2'-dichlorodiethyl ether (di-(2-chloroethyl) ether) was then added and the mixture refluixed for 2 hours then diluted as in Example 1 to 10% strength ready for testing.

EXAMPLE 5

8.8 g (0.1 mole) 3-methylamino-propylamine was dissolved in 50 ml of water in a 250 ml round bottomed flask fitted with stirrer and reflux condenser. 30.3 g (0.15 mole) of 1,3-dibromopropane were added and the mixture refluxed for 3 hours and then diluted as in Example 1 to 20% strength ready for testing.

The following Examples illustrate the use of these reaction mixtures, sometimes in combination with the quaternised substituted pyridine compounds already discussed, in alkaline non-cyanide zinc plating solution.

An alkaline non-cyanide zinc solution was made by using 2.5 g zinc oxide, and 97.5 g sodium hydroxide per liter, the heat of solution of the sodium hydroxide being used to dissolve the zinc oxide. The solution was then analysed and adjusted so that it contained 10.0 g per liter zinc ion and 100.0 g per liter hydroxyl ions.

Other concentrations of zinc ion and hydroxyl ion may be preferred in commercial practice and the above solution is only used to illustrate the action of the chemicals of this invention.

As a comparison, the following experiment was effected using no pyridine-containing reaction mixture. To 267 ml of the above solution in a standard Hull cell was added 1.0 g/l of the reaction mixture obtained from 1 mole of sodium nicotinate and 1 mole of benzyl chloride. A Hull cell panel was plated at 2 amps for 10 minutes, then half dipped in ½% nitric acid. The resultant zinc plate was not much better than that obtained from the alkaline non-cyanide zinc solution alone, being only slightly more uniform and of a lighter colour. Addition of more of the reaction mixture did not produce a better plate.

EXAMPLE 6

To 267 ml of the alkaline non-cyanide zinc solution in a Hull cell was added 2.0 g/l of the reaction mixture obtained in Example 1 between dimethylaminopropylamine and 1,3-dibromopropane. A steel panel was plated for 10 minutes at 2 amps and then half dipped in ½% nitric acid.

The resultant zinc plate was uniform and semi-bright.

EXAMPLE 7

To 267 ml of alkaline non-cyanide zinc solution in a Hull cell was added 2.0 g/l of the reaction mixture obtained in Example 1 between dimethylaminopropylamine and 1,3-dibromopropane and 1.0 g/l of the reaction mixture obtained from 1 mole of sodium nicotinate and 1 mole of benzyl chloride. A steel panel was plated for 10 minutes at 2 amps, then half dipped in ½% nitric acid. The resultant panel was mirror bright being only slightly more yellow in the undipped portions.

EXAMPLE 8

To a Hull cell portion of alkaline non-cyanide zinc solution was added 3.0 g/l of the reaction mixture obtained in Example 4 between N,N,N'-trimethylethylene diamine and 2,2'-dichlorodiethyl ether and 2.0 g/l of the reaction product of sodium nicotinate and allyl bromide (1:1 molar ratio). A Hull cell panel was plated at 2 amps for 10 minutes then half dipped in ½% nitric acid. The deposit so obtained was uniform and bright, but more yellow than that obtained in the previous Example, particularly the undipped portion.

EXAMPLE 9

To 267 ml of the alkaline non-cyanide zinc solution was added 6.0 g/l of the reaction mixture obtained in Example 2 and 10 g/l of the reaction product of sodium nicotinate and benzyl chloride (1:1 molar ratio). A Hull cell panel was plated for 10 minutes at 2 amps, then half dipped in ½% nitric acid. The panel was bright but had a dull patch on its high current density region, i.e. from 60 A/ft$^2$ upwards.

EXAMPLE 10

Liquid Additive Composition For Initial Make-Up of Bath

An aqueous composition for addition to an alkaline, cyanide-free zinc plating bath contains:

Linear polyamine of Example 1 — 200 g/liter

Quaternary derivative obtained by reaction of benzyl and sodium nicotinate — 100 g/liter.

EXAMPLE 11

Liquid Additive Composition For Maintenance Purposes:

In order to maintain the bath obtained by addition of the composition of the previous Example in optimum condition and replace the organic compounds in the proportion in which they are consumed, an aqueous additive can be made containing the following:

Linear polyamine of Example 1 — 140 g/liter

Quaternised pyridine compound prepared from benzyl chloride and sodium nicotinate — 50 g/liter.

I claim:

1. In an aqueous alkaline, cyanide-free zinc electroplating bath containing zinc ions and hydroxyl ions, the improvement comprising: including in said bath an effective brightening amount of at least one linear polyamine obtained by condensing a diamine of the formula:

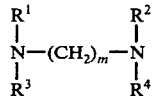

(I)

where $R^1$, $R^2$, $R^3$ and $R^4$, which may be the same or different, each represent a hydrogen atom or an alkyl group with 1 to 4 carbon atoms, and where $m$ is an integer from 1 to 5, with a dihalide of the formula $$X-(CH_2)_n-Y-(CH_2)_p-X \quad \text{(II)}$$

where X represents a halogen atom, Y represents an oxygen atom, an ethynylene group (—C≡C—), an ethenylene group (—HC=CH—), or a group

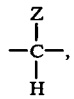

where Z represents a hydrogen atom or an alkyl group with 1 to 4 carbon atoms and $n$ and $p$, which may be the same or different, are zero or an integer from 1 to 5.

2. A bath according to claim 1 in which the linear polyamine is the condensate of a dihalide of formula (II) selected from the group consisting of 1,2-dibromoethane, 1,2-dibromoethylene, 1,3-dibromobutane, 1,4-dibromobutane, 1,6-dibromohexane, 1,2-dibromopropane, 1,3-dibromomopropane, 1,4-dibromobut-2-yne, 1,2-dichlorobutane, 1,3-dichlorobutane, 1,4-dichlorobutane, 1,3-dichloro-2-butene, 1,4-dichloro-2-butyne, 1,2-dichloroethane, 1,2-dichloroethylene, 1,6-dichlorohexane, 1,2-dichloropropane, 1,3-dichloropropane, di-(2-chloroethyl) ether, 1,2-diiodoethane, 1,3-diiodopropane and 1,4-diiodobutane.

3. A bath according to claim 1 in which the linear polyamine is the condensate of a diamine of formula (I) selected from the group consisting of 1,2-diaminoethane, 1,3-diaminopropane, 1,4-diaminobutane, 3-methylaminopropylamine, 3-cyclohexylaminopropylamine N,N'-diethyl-ethylenediamine, N,N'-dimethyl-ethylenediamine, 3-dimethylamino-propylamine, 3-diethylamino-propylamine, 4-diethylamino-butylamine, 2-dimethylamino-ethylamine, 2-diethylamino-ethylamine, N,N,N'-trimethyl-ethylene diamine, N,N,N'-triethyl-ethylene diamine and N,N,N',N'-tetramethyl-1,2-diamino-ethane.

4. A bath according to claim 1 in which the linear polyamine is the condensate of a diamine selected from the group consisting of 3-dimethylaminopropylamine, N,N,N',N'-tetramethyl-1,2-diaminoethane, N,N-dimethyl-N'-ethyl-ethylenediamine, N,N,N'-trimethyl-ethylenediamine and 3-methylaminopropylamine, and a dihalide selected from the group consisting of 1,3-dibromopropane, 1,2-dibromoethane, and di-(2-chloroethyl) ether.

5. A bath according to claim 1 in which the linear polyamine is a condensate of a diamine and a dihalide in a molar ratio of from 2:1 to 1:2.

6. A bath according to claim 1 containing 0.01 to 100 g/liter of the linear polyamine.

7. A bath according to claim 6 containing 0.1 to 10 g/liter of the linear polyamine.

8. In an aqueous alkaline, cyanide-free zinc electroplating bath containing zinc ions and hydroxyl ions, the improvement comprising: including in said bath an effective brightening amount of a. at least one linear polyamine obtained by condensing a diamine of the formula:

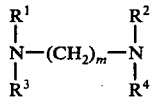

(I)

where $R^1$, $R^2$, $R^3$ and $R^4$, which may be the same or different, each represent a hydrogen atom or an alkyl group with 1 to 4 carbon atoms, and where $m$ is an integer from 1 to 5, with a dihalide of the formula $$X-(CH_2)_n-Y-(CH_2)_p-X \quad \text{(II)}$$

where X represents a halogen atom, Y represents an oxygen atom, an ethynylene group (—C≡C—), an ethenylene group (—HC=CH—), or a group

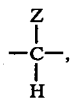

where Z represents a hydrogen atom, an alkyl group with 1 to 4 carbon atoms or a hydroxy group, and *n* and *p*, which may be the same of different, are zero or an integer from 1 to 5; provided that when Z represents a hydroxy group and *n* and *p* are both 1, $R^1$ and $R^2$ in formula (I) both represent hydrogen atoms; together with b. at least one of a pyridine compound of formula IIIa or a pyridine compound having a cation of formula III (*b*)

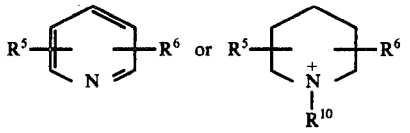

(IIIa) (IIIb)

where $R^5$ represents a hydrogen atom or an alkyl group with 1 to 5 carbon atoms; and $R^6$ represents a cyano group, a group -COOR$^7$ where $R^7$ represents a hydrogen atom, an alkali metal cation or an alkyl group with 1 to 5 carbon atoms; or a group —CONR$^8$R$^9$ where $R^8$ and $R^9$ which may be the same or different each represents a hydrogen atom or an alkyl group with 1 to 5 carbon atoms; and $R^{10}$ represents a radical selected from the group consisting of aralkyl, alkyl, alkenyl, esterified carboxyalkyl and hydroxyalkyl groups.

9. A bath according to claim 8 in which a pyridine compound is used in which $R^6$ is in the 3- position.

10. A bath according to claim 8 in which the pyridine compound is selected from the group consisting of nicotinic acid, nicotinamide, N,N-diethyl-nicotinamide, 3-cyanopyridine, 4-cyanopyridine, methyl nicotinate, ethyl nicotinate, isonicotinic acid, 2-picolinic acid and butyl nicotinate and quaternised derivatives thereof.

11. A bath according to claim 10 in which the pyridine compound is quaternised by a radical selected from the group consisting of benzyl, ethoxycarbonylmethyl, propyl, allyl, ethyl, 2-hydroxyethyl, 2-ethoxycarbonylethyl and 2-hydroxypropyl groups.

12. A bath according to claim 11 containing nicotinic acid or a salt thereof quaternised by a benzyl, allyl, or 2-ethoxycarbonylmethyl group.

13. A bath according to claim 8 containing 0.01 to 50 g/liter of the pyridine compound.

14. A bath according to claim 13 containing 0.1 to 5 g/liter of the pyridine compound.

15. A brightener composition for addition to an alkaline, cyanide-free zinc electroplating bath, comprising a mixed solution of a. at least one linear polyamine obtained by condensing a diamine of the formula:

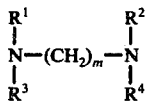

(I)

where $R^1$, $R^2$, $R^3$ and $R^4$, which may be the same or different, each represents a hydrogen atom or an alkyl group with 1 to 4 carbon atoms, and where *m* is an integer from 1 to 5, with an alkyl dihalide of the formula $$X-(CH_2)_n-Y-(CH_2)_p-X \quad (II)$$

where X represents a halogen atom; Y represents an oxygen atom, an ethynylene group (—C≡C—), an ethenylene group (—HC=CH—), or a group

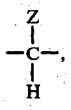

where Z represents a hydrogen atom, an alkyl group with 1 to 4 carbon atoms or a hydroxy group, and *n* and *p*, which may be the same different, are zero or an integer from 1 to 5; provided that when Z represents a hydroxy group, *n* and *p* are both 1 and $R^1$ and $R^2$ in formula (I) both represent hydrogen atoms; and b. at least one of a pyridine compound of formula IIIa or a pyridine compound having a cation of formula IIIb

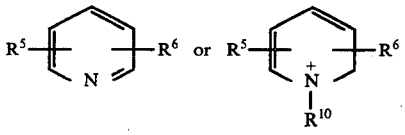

(IIIa) (IIIb)

where $R^5$ represents a hydrogen atom or an alkyl group with 1 to 5 carbon atoms; and $R^6$ represents a cyano group, a group -COOR$^7$ where $R^7$ represents a hydrogen atom, an alkali metal cation or an alkyl group with 1 to 5 carbon atoms; or a group CONR$^8$R$^9$ where $R^8$ and $R^9$ which may be the same or different each represents a hydrogen atom or an alkyl group with 1 to 5 carbon atoms and $R^{10}$ represents an aralkyl, alkyl, alkenyl, esterified carboxyalkyl or hydroxyalkyl group.

16. A composition according to claim 15 in which a pyridine compound is used in which $R^6$ is in the 3- position.

17. A composition according to claim 16 in which the pyridine compound is selected from nicotinic acid, nicotinamide N,N-diethyl-nicotinamide, 3-cyanopyridine, 4-cyanopyridine, methyl nicotinate, ethyl nicotinate, isonicotinic acid, 2-picolinic acid and butyl nicotinate and quaternised derivatives thereof.

18. A composition according to claim 17 in which the pyridine compound is quaternised by a group selected from benzyl, ethoxycarbonylmethyl, propyl, allyl, ethyl, 2-hydroxyethyl, 2-ethoxycarbonylethyl and 2-hydroxypropyl groups.

19. A composition according to claim 18 containing nicotinic acid or a salt thereof quaternised by a benzyl, allyl, or 2-ethoxycarbonylmethyl group.

20. A composition according to claim 15 in which the linear polyamine is the condensate of a diamine of formula (I) selected from 1,2-diaminoethane, 1,3-diaminopropane, 1,4-diaminobutane, 3-methylaminopropylamine, 3-cyclohexylaminopropylamine, N,N'-diethylethylenediamine, N,N'-dimethyl-ethylenediamine, 3-dimethylamino-propylamine, 3-diethylamino-propylamine, 4-diethylamino-butylamine, 2-dimethylamino-ethylamine, 2-diethylamino-ethylamine, N,N,N'-trimethyl-ethylene diamine, N,N,N'-triethyl-ethylene diamine and N,N,N'N'-tetramethyl-1,2-diamino-ethane.

21. A composition according to claim 15 in which the linear polyamine is the condensate of a dihalide of formula (II) selected from 1,2-dibromoethane, 1,2-dibromoethylene 1,3-drbromobutane, 1,4-dibromobutane, 1,4-dibromobutan-2-ol, 1,6-dibromohexane, 1,2-dibromopropane, 1,3-dibromopropane, 1,3-dibromopropan-2-ol, 1,4-dibromobut-2-yne, 1,2-dichlorobutane, 1,3-dichlorobutane, 1,4-dichlorobutane, 1,3-dichloro-2-butene, 1,4-dichloro-2-butyne, 1,2-dichloroethane, 1,2-dichloroethylene, 1,6-dichlorohexane, 1,2-dichloropropane, 1,3-dichloropropane, 1,3-dichloropropan-2-ol, di-(2-chloroethyl) ether, 1,2-diiodoethane, 1,3-diiodopropane and 1,4-diiodobutane.

22. A composition according to claim 15 in which the linear polyamine is the condensate of a diamine selected from 3-dimethylaminopropylamine, N,N,N',N'-tetramethyl-1,2-and a diaminoethane, N,N-dimethyl-N'-ethyl-ethylenediamine, N,N,N'-trimethyl-ethylenediamine and 3-methtlaminopropylamine, and a dihalide selected from 1,3-dibromopropane, 1,2-dibromoethane, and di-(2-chloroethyl) ether.

23. A composition according to claim 15 in which the linear polyamine is a condensate of a diamine and a dihalide in a molar ratio of from 2:1 to 1:2.

24. A composition according to claim 15 in which component (a) and component (b) are present in a ratio of from 2:1 to 1:2.

* * * * *

UNITED STATES PATENT OFFICE

CERTIFICATE OF CORRECTION

Patent No. 4,071,419 Dated January 31, 1978

Inventor(s) Barrie Sydney James

It is certified that error appears in the above-identified patent and that said Letters Patent are hereby corrected as shown below:

In the Claims

Column 8, Line 4, "1,3-dibromomopropane" should be --1,3-dibromopropane--;

Column 8, Line 16, after "3-cyclohexylaminopropylamine" insert --,--;

Column 9, Line 3, "of" should be --or--;

Column 9, Line 15, "or 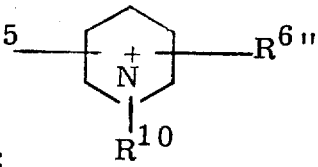 should be

-- 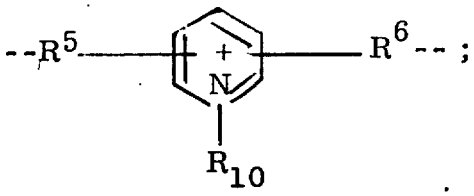 --;

UNITED STATES PATENT OFFICE

CERTIFICATE OF CORRECTION

Patent No. 4,071,419 Dated January 31, 1978

Inventor(s) Barrie Sydney James

It is certified that error appears in the above-identified patent and that said Letters Patent are hereby corrected as shown below:

In the Claims (cont'd.)

Column 10, Line 18, "or 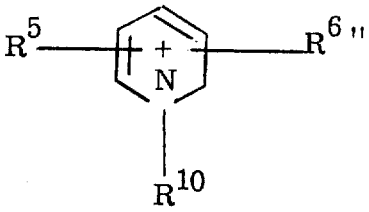 should be

-- 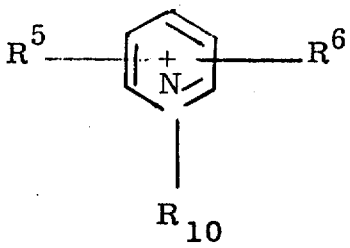 --;

Column 10, Line 65, "1,3-drbromobutane" should be --1,3-dibromobutane--;

Column 11, Line 10, delete "and a";

Column 12, Line 1, "3-methtlaminopropylamine" should be --3-methylaminopropylamine--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*